US006616392B2

(12) United States Patent
Sagel

(10) Patent No.: US 6,616,392 B2
(45) **Date of Patent: *Sep. 9, 2003**

(54) INPUT CONTROL FOR ROTARY SEALING TURRET

(75) Inventor: Joseph Paul Sagel, Highland Village, TX (US)

(73) Assignee: Recot, Inc., Pleasanton, CA (US)

( * ) Notice: This patent issued on a continued prosecution application filed under 37 CFR 1.53(d), and is subject to the twenty year patent term provisions of 35 U.S.C. 154(a)(2).

Subject to any disclaimer, the term of this patent is extended or adjusted under 35 U.S.C. 154(b) by 0 days.

(21) Appl. No.: 09/558,966

(22) Filed: Apr. 25, 2000

(65) Prior Publication Data

US 2003/0063964 A1 Apr. 3, 2003

(51) Int. Cl.[7] ..... B21D 51/30

(52) U.S. Cl. ..... 413/3; 413/2; 413/1; 53/272; 53/276

(58) Field of Search ..... 413/1–3, 45, 52, 413/30; 53/272, 276, 306, 334; 219/604; 72/421

(56) References Cited

U.S. PATENT DOCUMENTS 1,667,991 A * 5/1928 Russell ..... 198/463.4
2,301,949 A * 11/1942 Hothersall ..... 53/271
2,729,377 A * 1/1956 O'Neil ..... 53/306
3,290,863 A * 12/1966 Geber ..... 53/360
3,340,668 A * 9/1967 Bofinger ..... 53/86
3,755,987 A * 9/1973 Dardaine et al. ..... 53/306
4,219,986 A * 9/1980 Osterhaus ..... 53/334
4,547,645 A * 10/1985 Smith et al. ..... 219/604
4,719,739 A * 1/1988 Foldesi ..... 53/306
4,808,053 A * 2/1989 Nagai et al. ..... 413/30
4,928,511 A * 5/1990 Sirvet ..... 72/421
5,419,094 A * 5/1995 Vander Bush, Jr. et al. .. 53/371
5,522,200 A * 6/1996 Foldesi et al. ..... 53/329.4
6,035,607 A * 3/2000 Miller ..... 53/272

* cited by examiner

*Primary Examiner*—John Sipos
*Assistant Examiner*—Louis Huynh
(74) *Attorney, Agent, or Firm*—Colin P. Cahoon; Carstens, Yee & Cahoon, L.L.P.

(57) ABSTRACT

A method and apparatus for regulating the throughput of a rotary turret heat-sealing machine, without changing the rotational speed of the rotary turret. An indexing clutch is controlled to feed cans into the rotary turret such that only a predetermined number of sealing heads are used to seal cans fed therein. The predetermined number of cans is calculated based on a desired throughput rate. Dwell times, temperatures, and pressures can remain constant while varying radically the can throughput.

4 Claims, 2 Drawing Sheets

INPUT CONTROL FOR ROTARY SEALING TURRET

BACKGROUND OF THE INVENTION

1. Technical Field

The present invention relates to a method and apparatus for varying the canister throughput rate in a rotary sealing turret while maintaining consistent sealing times per unit and, in particular, to the use of an indexing clutch system that controls the feeding of canisters into specific turret positions while the turret maintains a constant rotational speed. The invention allows for wide variations in production speeds without the need for excessive speed ramping or sealing application adjustments.

2. Description of Related Art

There exists in the canning and food packaging industries a number of different methods for sealing "cans" or "canisters," which terms are used interchangeably throughout this applications. The methodologies available, however, are greatly narrowed when the can or canister that must be sealed has, for example, an elliptical shape and a paper or cardboard bottom, such as the canisters shown in FIGS. 1*a* and 1*b*.

Such canister typically may comprise an elliptical tube 102 (or other shape such as round, triangular, or square) made of paper or cardboard and layered with other material to provide the necessary barrier properties and is used as a vessel for holding a product, such as potato chips. The elliptical tube 102 typically arrives at the food packaging line with a hermetic removable seal 104 placed on a first end with a plastic over cap 106 seated over the removable seal 104, although it also might arrive with the first end open and the second end sealed. The canisters illustrated in FIGS. 1*a* and 1*b* are shown inverted, since the removable seal 104 and overcap 106 will be oriented at the top of the canister when displayed for sale.

A food product, such as potato chips, is deposited in the open second end of the canister, which is then sealed by a paper or cardboard end cap 108. A paper end cap 108 is preferred to a metal end cap due to manufacturing cost savings of three to five-fold involved in using the paper end cap.

The sealing means used to apply the paper end cap 108 to an elliptical canister in the prior art is a sealing machine applying a heat and pressure seal using a rotary sealing turret having a plurality of sealing heads, such as those manufactured by Blema Kircheis of Germany. During the heat-sealing process, such machine seals the end cap 108 to the inner and outer sides of the tube 102.

An overhead schematic of a typical prior art sealing machine in this regard is shown in FIG. 2. Open and filled canisters 220, oriented as illustrated in FIG. 1*a* with the open end up and without the paper end cap installed, are placed on an input conveyor 222. The containers 220 proceed down the conveyor 222 and are received in an indexing clutch 224. The indexing clutch 224 regulates individual canisters 220 into channels on a timing or worm screw 226 such that canisters 220 are deposited at evenly spaced intervals on the timing screw 226. The timing screw 226 then provides the needed separation between the canisters 220 for placement in an infeed star wheel 228. The infeed star wheel then places a canister in each of one positions 230 of a rotary turret 232. The end caps are fed from a second station and deposited in a sealing head. Sealing heads (not shown) located above each position apply the end caps to the open end of each canister by asserting heat and pressure to the end caps as they are sealed on the canisters. The rotary turret 232 illustrated in FIG. 2 comprises an 8-head configuration, with each head position marked 1 through 8. However, rotary sealing machines can be constructed with any number of heads typically varying from 2 heads to 12 heads.

The end cap is applied over the open end as the canisters 220 enters the rotary turret 232. The sealing head then applies heat and pressure to the end cap to activate the sealing properties of the end cap as each canister rotates through 270° around the sealing turret 232. The dwell time for the application of the heat and pressure is dependent on the rotational speed 250 of the rotary turret 232. After the end cap is attached, the now sealed canisters 221 are fed onto an outfeed conveyor 234 by an outfeed star wheel 236.

Typically, the pressure applied by the sealing heads is fixed in accordance with the manufacturer's specifications for the sealing machine. The rotational speed 250 of the turret 232 (or resultant dwell time) and the temperature applied to the canisters 220 while in the turret 232, however, are both adjustable to compensate for the particular composition of the end caps. For example, end caps of varying thickness but made of similar material could require varying dwell times or temperature settings, or a combination of both, in order to optimally activate the end cap's sealing properties. Further, the dwell time and temperature applied can vary between caps using different materials with varying activation temperatures. By way of example, a composite paper cap of 13 pts thickness having a 25 g/ml sealing layer coated over a foil layer works best with a dwell time of 1.8 seconds at 160° C. However, a thicker end cap would require a longer dwell time, and an end cap using a material having a different sealing activation temperature would require a different sealing temperature.

It is desirable that the composition of the paper end cap remain constant during different canister applications for various reasons, such as quality control, consistent packaging presentations, inventory costs, and manufacturing costs. Unfortunately, once a particular type of end cap is selected, the dwell times and temperature settings are relatively inflexible. Consequently, the throughput of the sealing machine can only be varied slightly (10% or less) through what is referred to as "speed ramping." Speed ramping involves concurrently changing the speed of all system components in order to change the throughput rate. The inability to vary the throughput significantly using prior art methods gives rise to a significant production problem.

By way of example, it may be desirable to radically change the throughput of a single sealing machine in order to compensate for different canister sizes or production line volumes. On an 8-head turret, a typical paper based end cap with a sealant laminated inner surface, subjected to a 1.8 second dwell time at 220° C., results in a throughput of approximately 200 canisters per minute. However, slowing the turret down to produce a throughput of 50 cans per minute results in a dwell time of approximately 7.2 seconds. A paper based end cap exposed to 220° C. for 7.2 seconds would result in burning. However, lowering the temperature of the sealing heads sufficient to avoid burning would not activate the sealing material regardless of the longer sealing time. In order to stay within the temperature and dwell time constraints, speed ramping typically can only adjust the throughput of a sealing machine by about 10% without requiring a change in the composition of the end seals.

The inability to change the throughput of a sealing machine beyond minor speed ramping adjustments is problematic when throughput requirements change drastically. Such throughput requirements may be a result of changing the canister size from, for example, an 8-oz. canister to a 2-oz. canister. Typical food processing efficiencies require that the sealing machine run at a speed sufficient to handle a constant output of product from the product lines, regardless of the ultimate canister size. Thus, to handle the same volume of product while sealing 2-oz. cans would require a four-fold increase in the sealing head speed as compared to sealing 8 oz. cans. Such radical changes in the throughput of the sealing machine are simply not feasible in the prior art. The only alternative available in the prior art is to purchase a number of sealing machines, at a cost of typically $650,000.00 per machine, and run the machines in combination or alone in order to adjust the total line throughput of sealed canisters. In addition to further capital investment for each machine purchased, this prior art solution requires additional production floor space, labor costs, and maintenance to accommodate, operate, and maintain the additional machines.

Consequently, a need exists for a method and apparatus for varying the canister throughput of a rotary sealing turret beyond those variations presently available through speed ramping methods. Such method and apparatus should be capable of adjusting the throughput of a sealing machine on the order of four-fold or greater changes without requiring any changes to the sealing setting (speed and temperature) of the sealing machine or the composition of the end seal applied.

SUMMARY OF THE INVENTION

The proposed invention comprises a method and apparatus for regulating the can throughput of a rotary turret heat sealing machine while maintaining the rotary turret at a constant speed by indexing the input of cans into the machine.

The invention uses an input indexing clutch in order to feed cans into specifically-designated turret head positions. To reduce the can throughput fewer head positions are used, while maximum throughput is accomplished using all of the head positions. By maintaining the rotary turret at a constant speed, the dwell time, temperature, and pressure used by the sealing machine can be maintained constant despite radical adjustments in the throughput of the machine. This means that, for example, with an 8-head rotary turret, throughputs can be varied from $1/8^{th}$ of the maximum throughput and upwards while still using the same end cap material and machine sealing settings. Minor speed variations can be accomplished through traditional speed ramping methods.

The above as well as additional features and advantages of the present invention will become apparent in the following written detailed description.

BRIEF DESCRIPTION OF THE DRAWINGS

The novel features believed characteristic of the invention are set forth in the appended claims. The invention itself, however, as well as a preferred mode of use, further objectives and advantages thereof, will be best understood by reference to the following detailed description of illustrative embodiments when read in conjunction with the accompanying drawings, wherein:

DETAILED DESCRIPTION

Figure 1A:
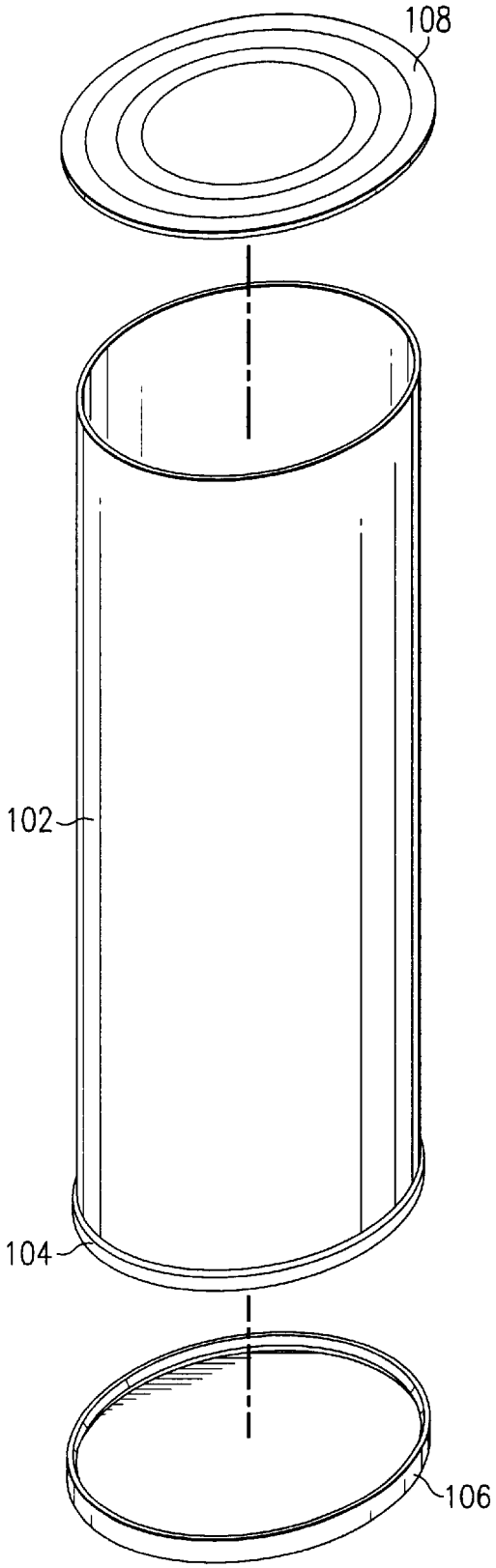
FIGS. 1*a* and 1*b* are perspective views in elevation of throughput canisters used with the present invention.
Figure 1B:
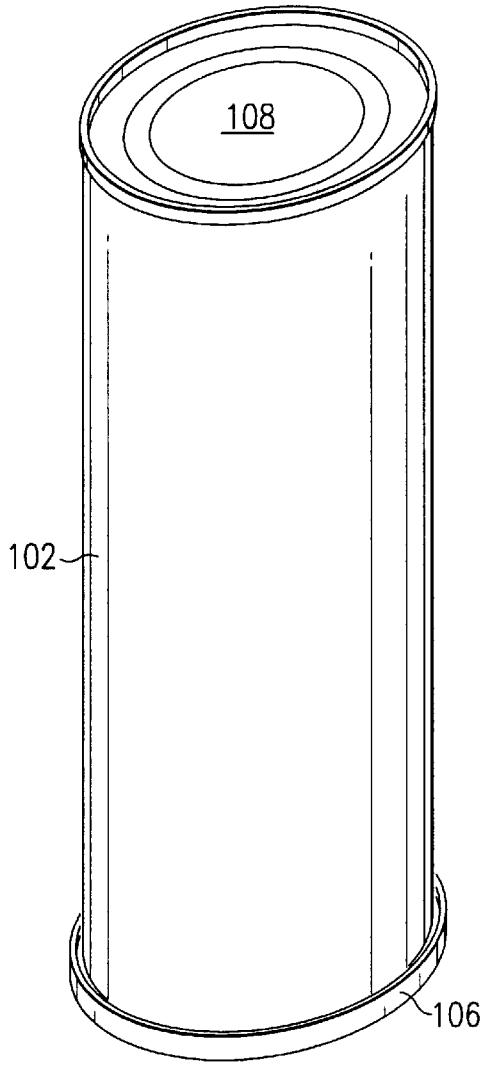
Figure 2:
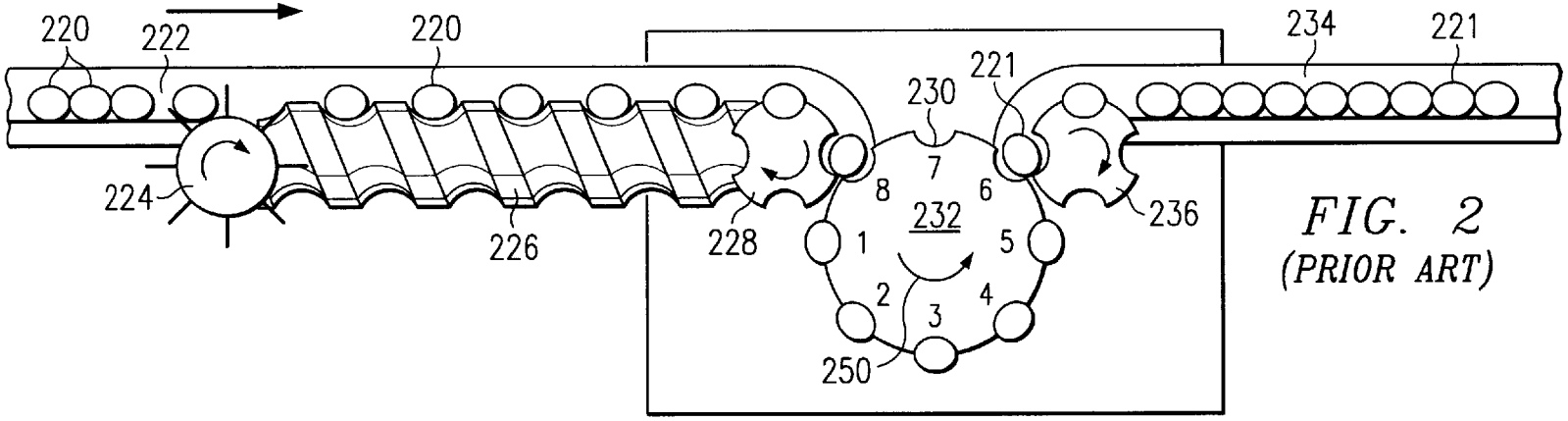
FIG. 2 (PRIOR ART)
FIG. 2 is a schematic top view representation of a prior art sealing machine.
Figure 3:
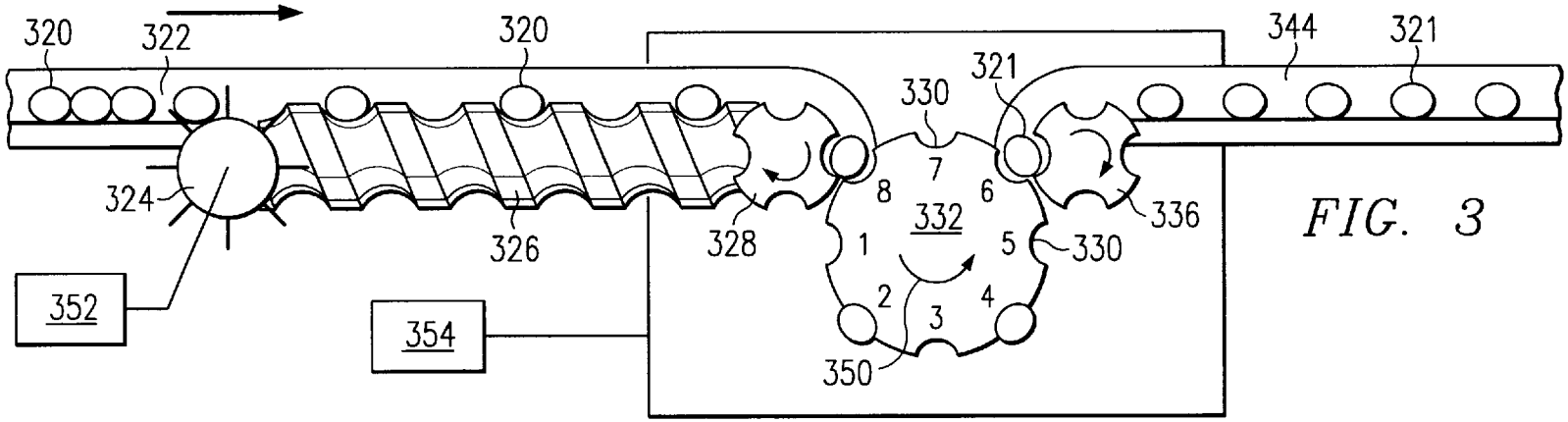
FIG. 3 is a schematic top view of one embodiment of the apparatus of the present invention.

FIG. 3 is an overhead schematic illustrating one embodiment of the present invention. As with the prior art sealing machine illustrated in FIG. 2, the sealing machine illustrated in FIG. 3 comprises an infeed conveyor 322 for transporting open and filled cans or canisters 320 to an indexing clutch 324. The canisters 320 then travel down a timing screw 326 to an infeed star wheel 328, which feeds the cans 320 into the sealing turret 332. Again, the sealing turret 332 can comprise two or more sealing heads and positions 330, which said positions 330 are labeled in FIG. 3 as 1 through 8. Sealed canisters 321 exit the sealing turret 332 at an outfeed star wheel 336, and then proceed down an outfeed conveyor 334.

The underlying principle of the invention is the maintenance of a relatively constant rotational speed 350 of the sealing head turret 332, while the can throughput can be greatly varied. This is accomplished by controlling the indexing clutch 324 to feed cans 320 at a predetermined rate. This predetermined rate is dependent on the desired throughput.

By way of example, the sealing machine can be configured for a maximum desired throughput speed using all available sealing head positions 330 (1 through 8). This maximum desired throughput speed is dependent on the end cap material used and will establish a relatively constant rotational speed 350 and constant temperature setting for the sealing heads. Once the maximum desired throughput speed has been determined, lower throughput speeds can be achieved as a ratio of sealing head positions 330 used divided by sealing head positions 330 available (also referred to by Applicant as a "fractional rate" of the maximum throughput). The mode illustrated in FIG. 3 shows the sealing machine running at half the maximum throughput, since only every other sealing head positions (Nos. 2, 4, 6, and 8) are being used.

While FIG. 3 illustrates a half-speed, or 4/8 speed, operation of the sealing machine, it can be seen that for an 8-head scaling turret 332, the machine speed could be run at $1/8^{th}$ speed by feeding only one scaling head position 330, 1/4 speed by feeding 2 scaling head positions 330, 3/8 th speed by feeding three sealing head positions 330, and so on, up to the maximum speed by feeding all eight sealing head positions 330. The operation speed is controlled by the controller 352 which is electrically connected to the indexing clutch 324 in order to control the indexing intervals at which canisters 320 are fed onto timing screw 326. Because the rotational speed 350 of the scaling head remains constant, the dwell times also remain constant regardless of the throughput rate selected. Consequently, the temperature setting of the scaling heads need not be changed. This allows for the use of the same type end cap material regardless of the throughput rate selected.

In order to maintain consistent sealing temperatures as between individual sealing heads, it is desirable that the same position numbered sealing heads be fed during any fractional rate throughput mode. For example, in the mode illustrated in FIG. 3, it is desirable that the same positions shown (Positions 2, 4, 6, and 8) are always the positions fed if these are the positions selected for the particular mode of operation. Feeding the cans 320 at random to any available turret position 330 would be unacceptable, since the sealing heads would then operate at inconsistent temperatures. This inconsistent temperature arises when one sealing head is used more frequently than another, thus allowing the less used sealing head to obtain a higher temperature than the sealing head that is more frequently used.

Minor speed adjustments can be accomplished using prior art speed ramping techniques. in fact, a monitoring device 354 electrically connected to the heat sealing machine 356 can be used to monitor upstream requirements to make real-time minor speed ramping adjustments. For example, an electronic sensor could be used to indicate a low and high speed ramping requirement to the entire system to handle upstream wit operation surges.

The present invention is a substantial improvement over the prior art in that dramatic changes can be made in the throughput of a sealing machine, for example 8-fold changes on an 8-machine, without changing the end-cap seal material, dwell times, or sealing temperature.

While the invention has been particularly shown and described with reference to a preferred embodiment, it will be understood by those skilled in the art that various changes in form and detail may be made therein without departing from the spirit and scope of the invention.

What is claimed is:

1. A method for adjusting the can throughput rate of a rotary turret sealing machine having a plurality of heat-sealing heads, said method comprising the steps of:

a) setting the rotational speed of the rotary turret at a constant speed determined by a maximum desired throughput;

b) setting the sealing temperature appropriate for sealing a given end cap to a can at said rotational speed; and c) determining a new desired throughput rate that is different from the maximum desired throughput; and d) regulating an input of cans into the machine at a fractional rate of the maximum desired throughput to achieve the new desired throughput rate without changing the rotational speed from that determined for the maximum desired throughput and without changing the sealing temperature from that determined for the maximum desired throughput, wherein the fractional rate is dependent on the number of sealing heads used on the rotary turret.

2. The method of claim 1 further comprising the steps of:

e) making minor adjustments to the new desired throughput rate by speed ramping.

3. The method of claim 1 further comprising the steps of:

e) monitoring the upstream throughput requirements of the sealing machine; and f) making minor adjustments to the new desired throughput rate based on the monitored throughput requirements.

4. The method of claim 1 wherein the regulating of the can input is accomplished by controlling an indexing clutch.

* * * * *